US008133387B2

(12) United States Patent
DePinto et al.

(10) Patent No.: US 8,133,387 B2
(45) Date of Patent: Mar. 13, 2012

(54) STATIONARY POOL SKIMMING APPARATUS

(75) Inventors: Nick DePinto, MIddletown, NJ (US); Shawn Kenavan, Middletown, NJ (US)

(73) Assignee: K&D of NJ, LLC, Middletown, NJ (US)

( * ) Notice: Subject to any disclaimer, the term of this patent is extended or adjusted under 35 U.S.C. 154(b) by 260 days.

(21) Appl. No.: 12/140,487

(22) Filed: Jun. 17, 2008

(65) Prior Publication Data

US 2009/0188851 A1 Jul. 30, 2009

Related U.S. Application Data

(60) Provisional application No. 61/062,786, filed on Jan. 29, 2008.

(51) Int. Cl.
*E04H 4/16* (2006.01)

(52) U.S. Cl. ..... 210/167.19; 210/232; 210/238

(58) Field of Classification Search ..... 210/167.1, 210/167.18, 167.19, 167.2, 232, 238; 4/490
See application file for complete search history.

(56) References Cited

U.S. PATENT DOCUMENTS

| | | | | |
|---|---|---|---|---|
| 4,734,189 | A * | 3/1988 | Page, Jr. | 210/167.18 |
| 4,904,379 | A * | 2/1990 | Ward | 210/167.18 |
| 5,510,020 | A * | 4/1996 | Gronlund | 210/167.18 |
| 5,849,184 | A * | 12/1998 | Veillet | 210/167.2 |
| 6,342,156 | B1 * | 1/2002 | Sanders et al. | 210/224 |
| 6,398,952 | B1 * | 6/2002 | Baer | 210/167.19 |
| 6,802,962 | B1 * | 10/2004 | Browne et al. | 210/164 |
| 2004/0108259 | A1 * | 6/2004 | Giannantonio | 210/169 |

* cited by examiner

*Primary Examiner* — Fred Prince
(74) *Attorney, Agent, or Firm* — Wall & Tong, LLP

(57) ABSTRACT

The present invention is a stationary pool skimming apparatus that uses the flow of water in a pool to collect free flowing debris from the water in the pool. In one embodiment, a pool skimming apparatus for collecting debris from water in a pool includes a frame having a net attached thereto. A first end of the frame includes a compression mechanism. The compression mechanism is adapted for being connected to a skimmer port of the pool such that the frame and net extend into the pool in a manner enabling the net of the pool skimming apparatus to collect debris from the water in the pool. The compression mechanism operates in either of an inverted position and a non-inverted position.

19 Claims, 10 Drawing Sheets

STATIONARY POOL SKIMMING APPARATUS

CROSS-REFERENCE TO RELATED APPLICATIONS

This application claims the benefit of U.S. Provisional Application No. 61/062,786, filed Jan. 29, 2008, which is incorporated by reference herein in its entirety.

FIELD OF THE INVENTION

The invention relates to the field of swimming pools and, more specifically, to skimming of debris from swimming pools.

BACKGROUND OF THE INVENTION

In order to clear a pool of free flowing debris, a person typically uses a pool skimmer which consists of a net attached to the end of a long pole. The person holds the pole of the pool skimmer and drags the net across the surface of the water in the pool in order to attempt to collect any debris that may be floating in the pool. Disadvantageously, however, a significant amount of time and energy must be expended by the person in order to clear the pool of free flowing debris.

SUMMARY OF THE INVENTION

Various deficiencies in the prior art are addressed through invention of a stationary pool skimming apparatus that uses the flow of water in a pool to collect free flowing debris from the water in the pool. In one embodiment, a pool skimming apparatus for collecting debris from water in a pool includes a frame having a net attached thereto. A first end of the frame includes a compression mechanism. The compression mechanism is adapted for being connected to a skimmer port of the pool such that the frame and net extend into the pool in a manner enabling the net of the pool skimming apparatus to collect debris from the water in the pool. The compression mechanism is adapted for being connected to the skimmer port of the pool independent of a direction of flow of the water in the pool.

BRIEF DESCRIPTION OF THE DRAWINGS

The teachings of the present invention can be readily understood by considering the following detailed description in conjunction with the accompanying drawings, in which.

To facilitate understanding, identical reference names have been used, where possible, to designate identical elements that are common to the figures.

DETAILED DESCRIPTION OF THE INVENTION

Figure 1A:
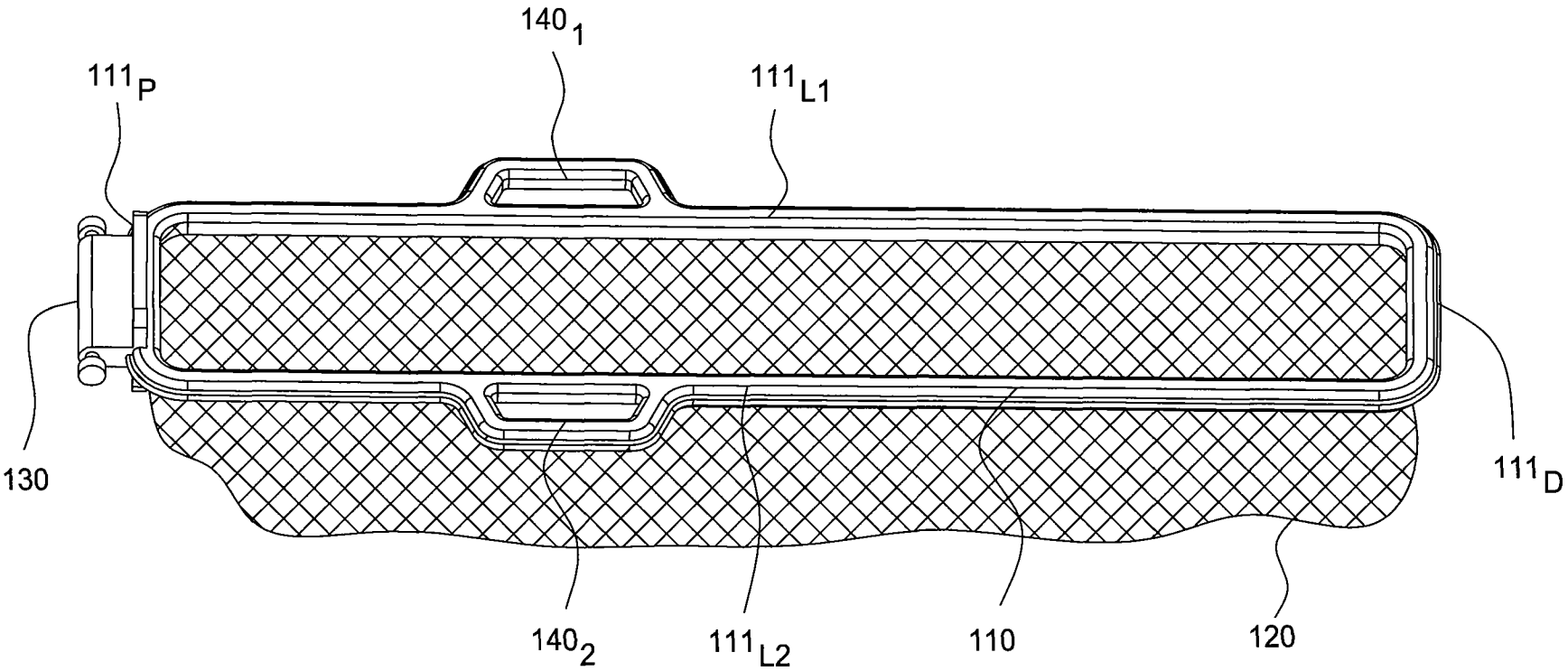
FIGS. 1A, 1B, 1C, and 1D depict embodiments of the stationary pool skimming apparatus.

The present invention is a stationary pool skimming apparatus that uses the flow of water in a swimming pool to automatically gather debris from the water in the pool. The stationary pool skimming apparatus is adapted for universal use in any type of pool (e.g., above-ground pools, in-ground pools, and the like) independent of the direction of flow of water in the pool. The stationary pool skimming apparatus may include various different combinations of features which enable the stationary pool skimming apparatus to be used in any type of pool and to be used independent of the direction of flow of water in the pool. The different embodiments of the stationary pool skimming apparatus may be better understood by way of reference to the figures and the associated description, which follows.

FIGS. 1A, 1B, 1C, and 1D depict embodiments of the stationary pool skimming apparatus. As depicted in FIGS. 1A-1D, the stationary pool skimming apparatus 100 includes a frame 110, a net 120, a compression mechanism 130, and a pair of handles $\mathbf{140}_1$ and $\mathbf{140}_2$ (collectively, handles 140). The stationary pool skimming apparatus 100 may further include other elements and/or features, as depicted and described herein.

The frame 110 forms an opening through which free flowing debris may pass to be gathered by the net 120. The frame 110 provides a net support mechanism to which net 120 is attached. The frame 110 may be any shape and/or size and, therefore, the corresponding opening formed by the frame 110 also may be any shape and/or size. The net 120 is attached to frame 110. The compression mechanism 130 forms (or is attached to) one end of frame 110. The handles 140 are attached to frame 110 in a manner enabling use of handles 140 to install and remove the stationary pool skimming apparatus 100 from the pool (e.g., along the sides of frame 110 that extend above and below the surface of the water in the pool).

In one embodiment, as depicted in FIG. 1A, the shape of frame 110 may be substantially rectangular. In one such embodiment, the frame 110 includes a first pair of ends (e.g., the shorter ends of the frame 110, which are denoted herein as a proximal end $\mathbf{111}_P$ and a distal end $\mathbf{111}_D$) and a second pair of ends (e.g., the longer ends of the frame 110, which are denoted herein as a first longitudinal end $\mathbf{111}_{L1}$ and a second longitudinal end $\mathbf{111}_{L2}$). In this embodiment, proximal end $\mathbf{111}_P$ and distal end $\mathbf{111}_D$ are substantially parallel to each other, and first longitudinal end $\mathbf{111}_{L1}$ and second longitudinal end $\mathbf{111}_{L2}$ are substantially parallel to each other. In this embodiment, as depicted in FIG. 1A, compression mechanism 130 is attached to proximal end $\mathbf{111}_P$, and the handles $140_1$ and $140_2$ are attached to first longitudinal end $111_{L1}$ and second longitudinal end $111_{L2}$, respectively.

Figure 1B:
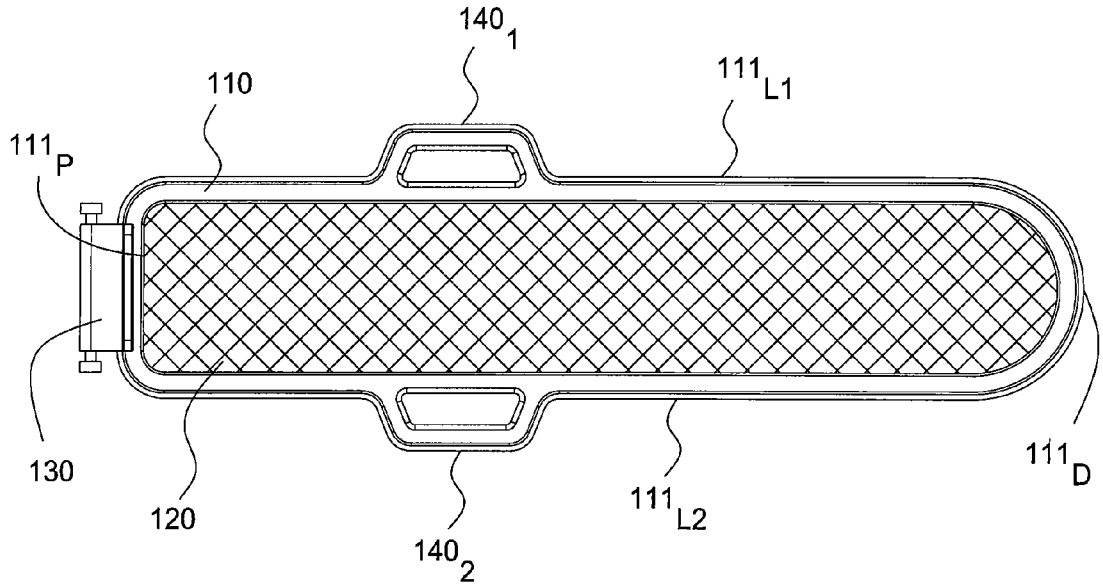
Figure 1C:
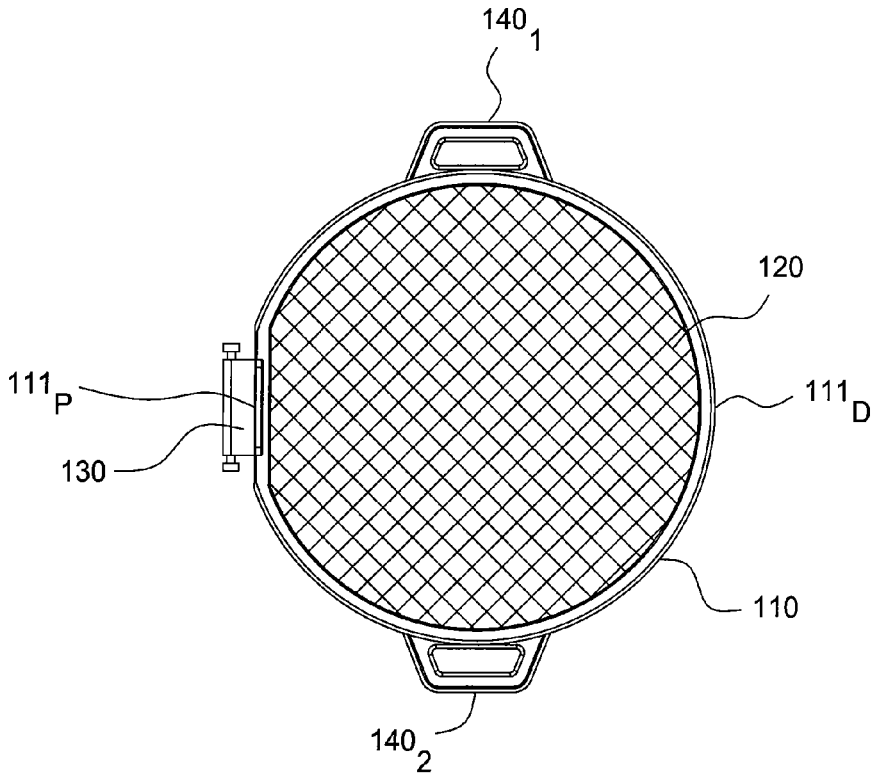

Although primarily depicted and described herein with respect to an embodiment in which frame 110 is substantially rectangular, as described herein the frame 110 may be implemented using other shapes. In another embodiment, for example, as depicted in FIG. 1B, the shape of frame 110 may be substantially rectangular at proximal end $111_P$ and substantially rounded at distal end $111_D$. In another embodiment, for example, as depicted in FIG. 1C, the shape of frame 110 may be substantially elliptical or circular. In other embodiments, frame 110 may take other shapes. In one embodiment, the frame 110 is substantially symmetrical, although this is not required.

In one embodiment, frame 110 may be approximately 4 to 12 inches wide, although other widths may be used for the frame (e.g., depending on the length of frame 110, the shape of frame 110, and like factors). The width of frame 110 may vary in the longitudinal direction (e.g., where frame 110 is shaped as illustrated in FIG. 1B, the width of the frame decreases near distal end $111_D$). In one embodiment, frame 110 may be approximately 24 to 60 inches long, although other lengths may be used for the frame. The width and/or length of the frame 110 may be different as needed (e.g., depending on one or more factors, such as the size of the pool, the shape of the pool, the shape of the frame 110, and like factors, as well as various combinations thereof).

The stationary pool skimming apparatus 100 may be adapted to extend any distance into the pool from the edge of the pool (i.e., from the side of the pool to which the stationary pool skimming apparatus is connected). In one embodiment, for example, the stationary pool skimming apparatus 100 may be adapted to extend approximately 24 to 60 inches into the pool (depending on the length of the stationary pool skimming apparatus, which may depend on the size of the pool and/or other factors). In one embodiment, the length of the frame 110 is fixed and, thus, the distance with which the stationary pool skimming apparatus extends into the pool is also fixed. In another embodiment, the length of the frame 110 is adjustable (e.g., the length of the frame 110 is adapted for being adjusted by the user as needed) and, thus, the distance with which the stationary pool skimming apparatus 100 extends into the pool is also adjustable as needed.

The net 120 is adapted to collect free flowing debris from the water in the pool as water flows through the net 120.

The net 120 is attached to the frame 110. The net 120 may be attached to the frame 110 in any manner. In one embodiment, the net 104 is attached to the frame along the inside edge of the frame 110 such that the net 120 may extend away from the frame 102 by approximately the same distance in either direction (without being obstructed by the frame 110), thereby enabling the stationary pool skimming apparatus 100 to be used in any pool independent of the direction in which the water is flowing in the pool.

The net 120 may be made of any material. The holes in the net 120 may be any size, depending upon the size of the debris that the net 120 is intended to collect. The net 120 may be any size and, thus, may extend any distance behind the frame 110 (i.e., may extend any distance in the direction in which the water is flowing in the pool). In one embodiment, for example, the net 120 may be adapted to extend approximately 4 to 24 inches behind the opening of the frame 110. In one such embodiment, for example, the net 120 may be adapted to extend approximately 12 inches behind the opening of the frame 110.

In one embodiment, as depicted in FIG. 1A, FIG. 1B, and FIG. 1C, the net may be uniform such that net 120 extends behind the frame 110 by approximately the same distance along the length of frame 110 (i.e., in the longitudinal direction between proximal end $111_P$ and distal end $111_D$).

Figure 1D:
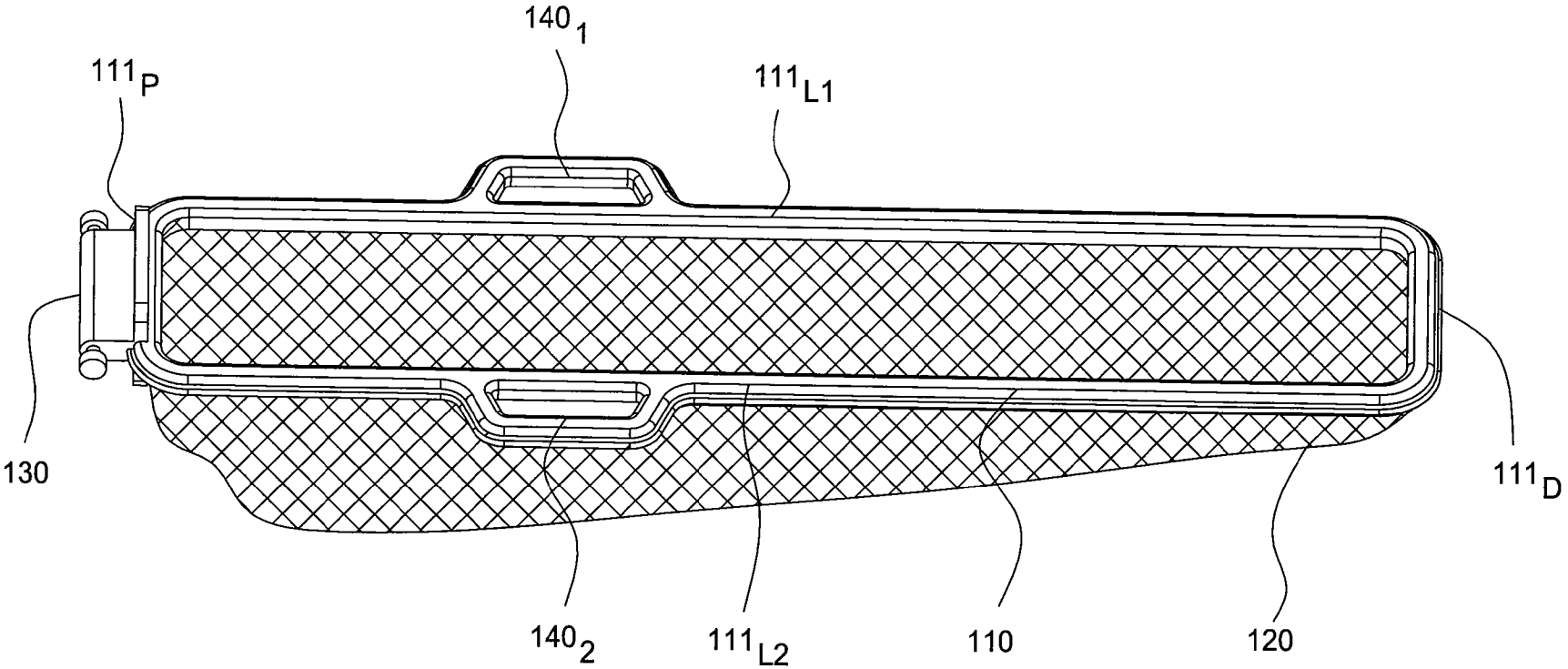

In another embodiment, as depicted in FIG. 1D, net 120 may be tapered. In one such embodiment, the distance with which the net 120 extends behind the frame 110 may increase in the direction from the distal end $111_D$ toward the proximal end $111_P$), thereby tending to direct debris that is captured by the net 120 toward the proximal end $111_P$ of stationary pool skimming apparatus 100 (i.e., directing debris toward the end of the stationary pool skimming apparatus 100 that is connected to the pool). This reduces drag as the water circulates through the net 120 since the flow of water through the net 120 is not obstructed by debris initially collected toward the distal end $111_D$. Any degree of tapering of the net may be used (e.g., from 2 inches at distal end $111_D$ to 16 inches at proximal end $111_P$, from 4 inches at distal end $111_D$ to 24 inches at proximal end $111_P$, and the like).

The stationary pool skimming apparatus 100 is adapted to be connected to a pool in any manner that enables the stationary pool skimming apparatus 100 to collect debris from the water in the pool as the water flows within the pool, independent of the direction in which the water flows within the pool. In other words, the stationary pool skimming apparatus 100 is rotatable such that the stationary pool skimming apparatus 100 may be connected to either side of the skimmer port in a pool. In one embodiment, as depicted and described herein, the stationary pool skimming apparatus 100 is rotatable around its longitudinal axis such that stationary pool skimming apparatus 100 may be connected to either side of the skimmer port (using compression mechanism 130) depending on the direction in which the water flows within the pool.

The stationary pool skimming apparatus 100 may be connected to the pool in any manner. In one embodiment, stationary pool skimming apparatus 100 is connected to the pool by inserting one end of the stationary pool skimming apparatus 100 into the opening of a skimmer port located in the wall of the pool (illustratively, inserting proximal end $111_P$, which includes compression mechanism 130, into the opening of a skimmer port in the wall of the pool).

In one embodiment, the stationary pool skimming apparatus 110 may be connected to the skimmer port substantially near one side of the skimmer port. In one such embodiment, the stationary pool skimming apparatus 110 may be connected to the skimmer port substantially near the side of the skimmer port that is opposite the direction from which the water flows within the pool, such that stationary pool skimming apparatus 110 may gather any debris that does not enter the skimmer port to be gathered by the skimmer basket in the skimmer port. This is depicted in greater detail in FIG. 3 and FIGS. 4A and 4B.

Figure 3:
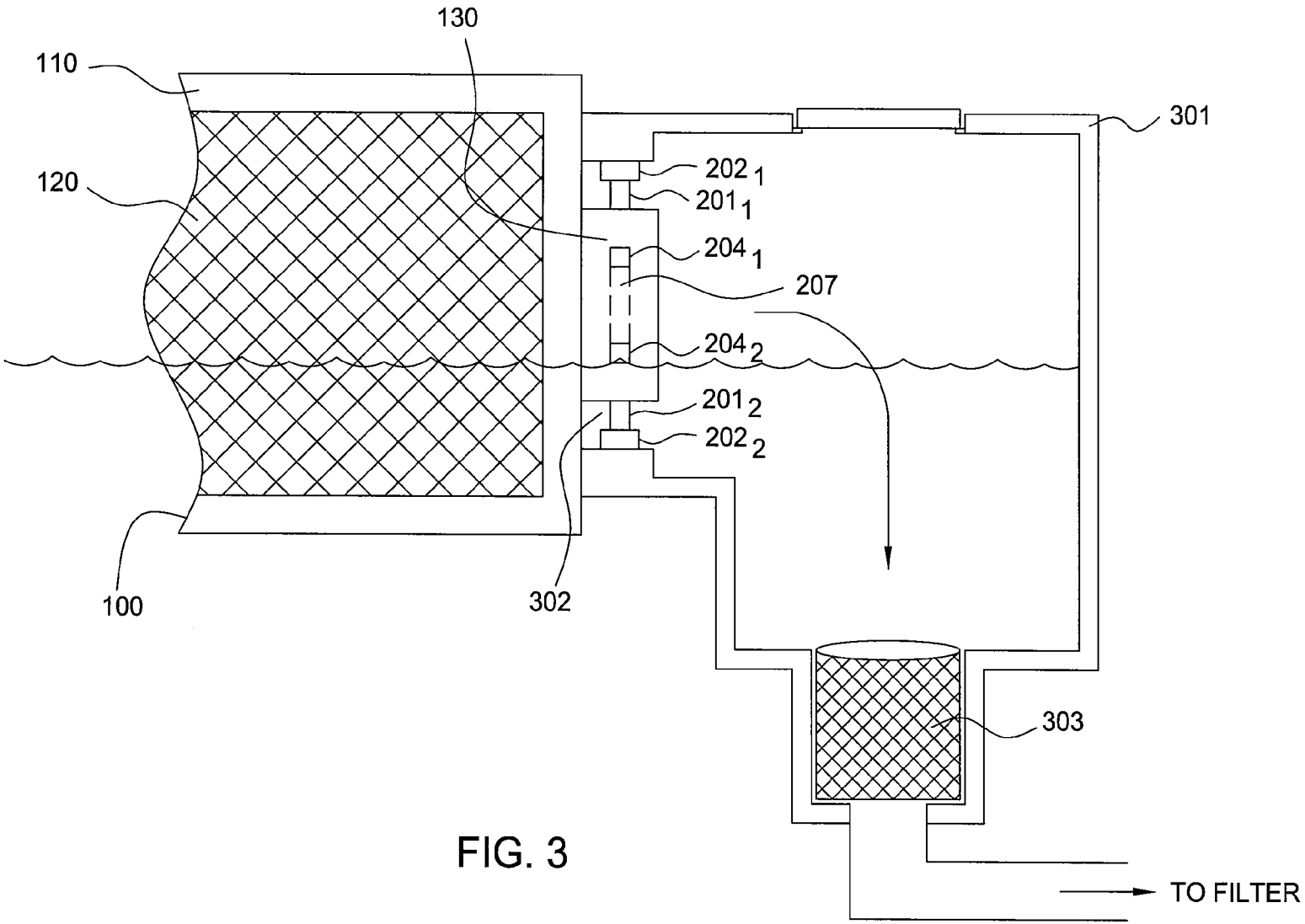
FIG. 3 depicts a cross-sectional view of the use of the compression mechanism of FIG. 2 to connect the stationary pool skimming apparatus to a skimmer port.

In such embodiments, since stationary pool skimming apparatus 100 is connected to the skimmer port in the pool wall, the stationary pool skimming apparatus 100 is automatically at a proper height and position with respect to the water level in the pool because the water level in the pool must be maintained such that water is flowing into the skimmer port of the pool to be cleansed by a pool filter. This is depicted in FIG. 3.

The stationary pool skimming apparatus 100 may be held in place using a connecting means. The connecting means may include any connecting means which may be used to connect stationary pool skimming apparatus 100 to the pool (i.e., to a skimmer port in the wall of the pool). In one embodiment, as depicted in FIG. 1, the connecting means is a compression mechanism adapted for connecting stationary pool skimming apparatus 100 to the skimmer port in the wall of the pool (illustratively, compression mechanism 130). An exemplary embodiment in which the connecting means is implemented as a compression mechanism is depicted and described in more detail with respect to FIG. 2.

The handles 140 provide a means by which a user may control the stationary pool skimming apparatus 100 as the stationary pool skimming apparatus 100 is being inserted into the pool or removed from the pool.

In one embodiment, the handles $\mathbf{140}_1$ and $\mathbf{140}_2$ are positioned on the first longitudinal end $\mathbf{111}_{L1}$ and second longitudinal end $\mathbf{111}_{L2}$ of the frame 110 of stationary pool skimming apparatus 100, respectively. In this manner, the user is provided a means by which to hold and control the stationary pool skimming apparatus 100 when connecting it to the skimmer port and disconnecting it from the skimmer port, independent of the direction in which the water flows within the pool.

The handles $\mathbf{140}_1$ and $\mathbf{140}_2$ may be located at any point along the first longitudinal end $\mathbf{111}_{L1}$ and second longitudinal end $\mathbf{111}_{L2}$ of the frame 110, respectively. In one embodiment, for example, as depicted in FIGS. 1A, 1B, and 1D, each of the handles 140 may be located between the proximal end $\mathbf{111}_P$ of stationary pool skimming apparatus 100 (i.e., the end of stationary pool skimming apparatus 100 that includes compression mechanism 130) and a midpoint of the respective longitudinal end $\mathbf{111}_L$ of the frame 110.

Although primarily depicted and described herein with respect to an embodiment in which the stationary pool skimming apparatus 100 includes two handles $\mathbf{140}_1$ and $\mathbf{140}_2$, in other embodiments the stationary pool skimming apparatus 100 may include fewer handles or more handles. Furthermore, the handles may be positioned differently with respect to frame 110.

Figure 2:
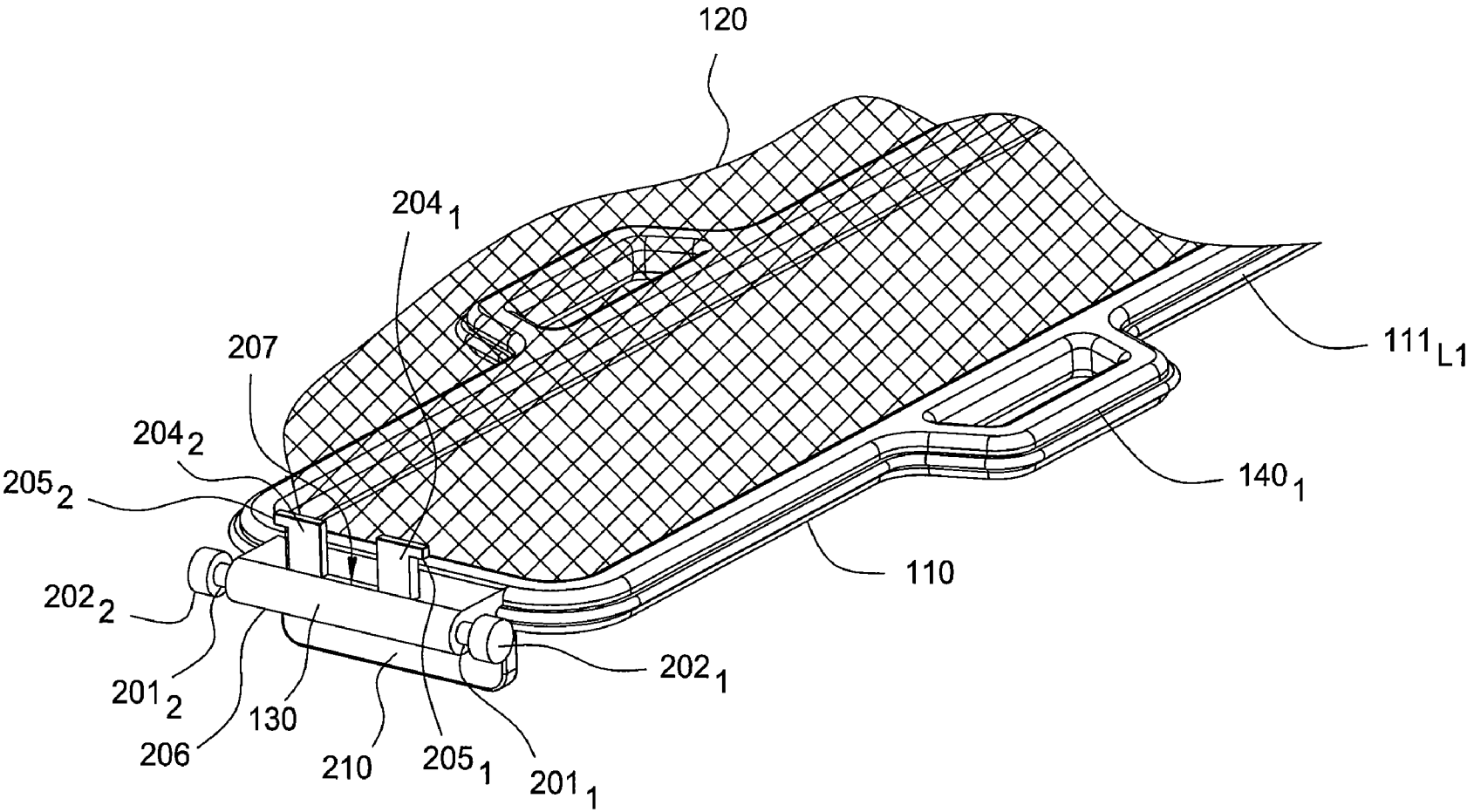
FIG. 2 depicts a more detailed view of one end of the stationary pool skimming apparatus of FIGS. 1A-1D, showing a compression mechanism adapted for use in connecting the stationary pool skimming apparatus to a skimmer port of a pool.

FIG. 2 depicts a more detailed view of one end of the stationary pool skimming apparatus of FIG. 1, showing a compression mechanism adapted for use in connecting the stationary pool skimming apparatus to a skimmer port of a pool. The compression mechanism 130 may be used to keep the stationary pool skimming apparatus 100 in place. The compression mechanism 130 may use any means of compression (e.g., spring compression, air compression, mechanical compression, and the like, as well as various combinations thereof).

As depicted in FIG. 2, the compression mechanism 130 includes a skimmer gripping means and an actuating means.

The skimmer gripping means may include any means of gripping the skimmer port of the pool in a manner enabling the stationary pool skimming apparatus 100 to be connected to the pool to collect free flowing debris from the water of the pool. The actuating means may include any means of controlling the compression mechanism 130 (i.e., controlling the skimmer gripping means of compression mechanism 130) in a manner enabling the stationary pool skimming apparatus 100 to be connected to the skimmer port and disconnected from the skimmer port.

In one embodiment, as depicted in FIG. 2, the skimmer gripping means of compression mechanism 130 includes a pair of pistons $\mathbf{201}_1$-$\mathbf{201}_2$ (collectively, pistons 201) having a respective pair of skimmer gripping ends $\mathbf{202}_1$ and $\mathbf{202}_2$ (collectively, skimmer gripping ends 202) attached thereto, and the actuating means of the compression mechanism 130 includes a pair of finger grips $\mathbf{204}_1$ and $\mathbf{204}_2$ (collectively, finger grips 204). As depicted in FIG. 2, compression mechanism 130 further includes a casing 206 which houses a portion of each of the pistons 201, and an opening 207 in casing 206 which forms a groove through which the finger grips $\mathbf{204}_1$ and $\mathbf{204}_2$ may slide as the finger grips $\mathbf{204}_1$ and $\mathbf{204}_2$ are actuated to control skimmer gripping ends $\mathbf{202}_1$ and $\mathbf{202}_2$.

The skimmer gripping ends $\mathbf{202}_1$ and $\mathbf{202}_2$ are attached to the ends of pistons $\mathbf{201}_1$ and $\mathbf{201}_2$, respectively. The skimmer gripping ends $\mathbf{202}_1$ and $\mathbf{202}_2$ are attached to the ends of pistons $\mathbf{201}_1$ and $\mathbf{201}_2$ outside of the casing 206 of compression mechanism 130 from which the pistons $\mathbf{201}_1$ and $\mathbf{201}_2$ extend. The finger grips $\mathbf{204}_1$ and $\mathbf{204}_2$ are attached to the sides of the pistons $\mathbf{201}_1$ and $\mathbf{201}_2$, respectively. The finger grips $\mathbf{204}_1$ and $\mathbf{204}_2$ are attached to the sides of the pistons $\mathbf{201}_1$ and $\mathbf{201}_2$ through an opening 207 in the side of casing 206 of compression mechanism 130.

As depicted in FIG. 2, the casing 206 of compression mechanism 130 houses a portion of each of the pistons 201. A hole at each end of the casing enables the pistons $\mathbf{201}_1$ and $\mathbf{201}_2$ to extend outside of the casing 206 to connect to the skimmer gripping ends $\mathbf{202}_1$ and $\mathbf{202}_2$, respectively. As further depicted in FIG. 2, the opening 207 of casing 206 forms a groove through which the finger grips $\mathbf{204}_1$ and $\mathbf{204}_2$ may slide as the finger grips $\mathbf{204}_1$ and $\mathbf{204}_2$ are actuated (e.g., squeezed together and released), such that the casing 206 does not obstruct the movement of the finger grips $\mathbf{204}_1$ and $\mathbf{204}_2$ and, thus, does not obstruct movement of the pistons $\mathbf{201}_1$ and $\mathbf{201}_2$ and the associated skimmer gripping ends $\mathbf{202}_1$ and $\mathbf{202}_2$ attached thereto.

In such embodiments, for example, finger grips $\mathbf{204}_1$ and $\mathbf{204}_2$ may be squeezed together, thereby causing pistons $\mathbf{201}_1$ and $\mathbf{201}_2$ to contract and, thus, causing the skimmer gripping ends $\mathbf{202}_1$ and $\mathbf{202}_2$ attached to the respective pistons $\mathbf{201}_1$ and $\mathbf{201}_2$ to contract such that the compression mechanism 130 may be inserted through the opening in the skimmer port and positioned in place on the skimmer port before being connected to the skimmer port. In this example, after the stationary pool skimming apparatus 100 is in position within the skimmer port, finger grips $\mathbf{204}_1$ and $\mathbf{204}_2$ are then released, thereby causing pistons $\mathbf{201}_1$-$\mathbf{201}_2$ to expand and, thus, causing the skimmer gripping ends $\mathbf{202}_1$ and $\mathbf{202}_2$ attached to respective pistons $\mathbf{201}_1$-$\mathbf{201}_2$ to expand to grip the skimmer port in a manner for holding the stationary pool skimming apparatus 100 in place during use.

In such embodiments, use of the finger grips $\mathbf{204}_1$ and $\mathbf{204}_2$ makes the compression mechanism 130 simple to use, thereby simplifying the insertion and removal of stationary pool skimming apparatus 100 from the pool (e.g., making it simple for the user to connect to the skimmer port and disconnect from the skimmer port).

In one embodiment, the skimmer gripping ends $\mathbf{202}_1$ and $\mathbf{202}_2$ of compression mechanism 130 may include respective waterproof pads, thereby enabling skimmer gripping ends $\mathbf{202}_1$ and $\mathbf{202}_2$ of compression mechanism 130 to grip the inside of the skimmer port. For example, the waterproof pads used on skimmer gripping ends $\mathbf{202}_1$ and $\mathbf{202}_2$ may be made of rubber, plastic, or any other waterproof material.

In one embodiment, finger grips $\mathbf{204}_1$ and $\mathbf{204}_2$ may include respective support tabs $\mathbf{205}_1$ and $\mathbf{205}_2$, respectively. The support tabs $\mathbf{205}_1$ and $\mathbf{205}_2$ provide lateral support for the user's fingers as the user squeezes the finger grips $\mathbf{204}_1$ and $\mathbf{204}_2$ toward each other while connecting the stationary pool skimming apparatus 100 to the skimmer port of the pool. In other words, the support tabs $\mathbf{205}_1$ and $\mathbf{205}_2$ will prevent the user's fingers from slipping off of the respective finger grips $\mathbf{204}_1$ and $\mathbf{204}_2$, especially where finger grips $\mathbf{204}_1$ and $\mathbf{204}_2$ may be wet and, thus, slippery.

Although primarily depicted and described herein with respect to skimmer gripping ends 202 having a particular shape and size, the skimmer gripping ends 202 may be implemented using various other shapes and/or sizes. For example, skimmer gripping ends 202 may shaped differently (e.g., using square skimmer gripping ends rather than circular skimmer gripping ends) in order to increase the surface area with which skimmer gripping ends 202 may grip the skimmer port of the pool. For example, skimmer gripping ends 202 may be made larger in order to increase the surface area with which skimmer gripping ends 202 may grip the skimmer port of the pool. Similarly, although primarily depicted and described with respect to finger grips 204 having a particular shape and size, the finger grips 204 may be implemented using various other shapes and/or sizes.

As depicted in FIG. 2, stationary pool skimming apparatus 100 includes a tab 210 extending therefrom.

The tab 210 is adapted to prevent the stationary pool skimming apparatus 100 from moving in the direction in which water is flowing in the pool (i.e., due to the force applied against the frame 110 and net 120 as the water flows in the pool). In other words, the tab 210 is adapted to keep the plane formed by the frame 110 of the stationary pool skimming apparatus 100 substantially perpendicular with respect to the plane of the wall of the pool, thereby preventing the distal end $\mathbf{111}_D$ of frame 110 from drifting due to force exerted on distal end $\mathbf{111}_D$ of frame 110 by the flow of water in the pool (e.g., due to force against the frame, force against the net, force against debris that has been collected in the net, and the like).

As depicted in FIG. 2, tab 210 extends from stationary pool skimming apparatus 100. The tab 210 extends from stationary pool skimming apparatus 100 on one side of the plane formed by the frame 110 of the stationary pool skimming apparatus 100. The tab 210 extends from stationary pool skimming apparatus 100 on the side of the plane formed by the frame 110 of the stationary pool skimming apparatus 100 that is opposite the side of the plane formed by the frame 110 of the stationary pool skimming apparatus 100 from which the finger grips 204 extend.

The tab 210 may extend from the stationary pool skimming apparatus 100 in any manner. For example, tab 210 may extend from the frame 110 (e.g., from the proximal end $\mathbf{111}_P$ of frame 110), from the compression mechanism 130, from an area substantially near a point at which the frame 110 and the compression mechanism 130 meet, and the like. In one embodiment, tab 210 extends from the stationary pool skimming apparatus 100 such that the plane formed by tab 210 is substantially perpendicular to the plane formed by the frame 110.

The tab 210 may be any shape and/or size. In one embodiment, for example, as depicted in FIG. 2, tab 210 may be substantially rectangular (although other shapes and/or sizes may be used). The shape and/or size of tab 210 may dictate the position within the skimmer port at which the stationary pool skimming apparatus 100 is connected.

As described herein, tab 210 is adapted to prevent the stationary pool skimming apparatus 100 from moving in the direction in which water is flowing in the pool, independent of the direction in which the water is flowing in the pool (i.e., the stationary pool skimming apparatus 100 may be installed on either side of the skimmer port, as needed, depending on the direction in which water is flowing in the pool). The use of tab 210 for preventing movement of stationary pool skimming apparatus 100 due to the flow of water in the pool is depicted and described herein with respect to FIG. 5.

FIG. 3 depicts a cross-sectional view of the use of the compression mechanism of FIG. 2 to connect the stationary pool skimming apparatus to a skimmer port that is located in the wall of a pool. As depicted in FIG. 3, a skimmer port 301 has a skimmer port opening 302. The skimmer port opening 302 provides an opening through which water in the pool may flow. As water flows into the skimmer port 301 through skimmer port opening 302, any large debris in the water is filtered by a skimmer basket 303 typically installed within the skimmer port 301, and the water and any smaller debris not collected by the skimmer basket 303 flow through a pipe to a filter (not shown) responsible for further filtering the water in the pool. The filtered water is then returned to the pool through one or more returns in the pool (also not shown).

As depicted in FIG. 3, the skimmer gripping ends $\mathbf{202}_1$ and $\mathbf{202}_2$ of compression mechanism 130 have been inserted through the skimmer port opening 302 of skimmer port 301 (e.g., by actuating finger grips $\mathbf{204}_1$ and $\mathbf{204}_2$ in order to contract pistons $\mathbf{201}_1$ and $\mathbf{201}_2$ and, thus, actuate associated skimmer gripping ends $\mathbf{202}_1$ and $\mathbf{202}_2$, thereby enabling skimmer gripping ends $\mathbf{202}_1$ and $\mathbf{202}_2$ to be inserted through the skimmer port opening 302 of the skimmer port 301) and are gripping the inner walls of the skimmer port in a manner for holding stationary pool skimming apparatus 100 in place to collect free flowing debris from the water in the pool.

As depicted in FIG. 3, when the stationary pool skimming apparatus 100 is connected to the skimmer port 301 in the wall of the pool, the stationary pool skimming apparatus 100 is automatically at a proper height and position with respect to the water in the pool, thereby ensuring that at least a portion of the debris that does not flow into skimmer port 301 through skimmer port opening 302 is instead directed into net 120 of stationary pool skimming apparatus 100. More specifically, in the embodiment that is depicted in FIG. 3, stationary pool skimming apparatus 100 is rectangular (e.g., as depicted and described herein with respect to FIG. 1A) and, thus, one of the longitudinal ends $\mathbf{111}_L$ of frame 110 is located above the surface of the water and the other of the longitudinal ends $\mathbf{111}_L$ of frame 110 is located below the surface of the water such that any free flowing debris at or near the surface of the water is collected in the net 120 as the water in the pool flows through the net 120.

From FIG. 3, it may be seen that the distance by which the stationary pool skimming apparatus (e.g., the first and second longitudinal ends $\mathbf{111}_L$ of frame 110, where stationary pool skimming apparatus is rectangular or otherwise elongated) extends above and below the skimmer port opening 302 is such that, regardless of the orientation of stationary pool skimming apparatus 100 (i.e., even where stationary pool skimming apparatus is rotated 180 degrees around its longitudinal axis), the net 120 of stationary pool skimming apparatus 100 extends above and below the surface of the water by a distance sufficient to enable any free flowing debris at or near the surface of the water to be collected in the net 120 as the water in the pool flows through the net 120.

Figure 4A:
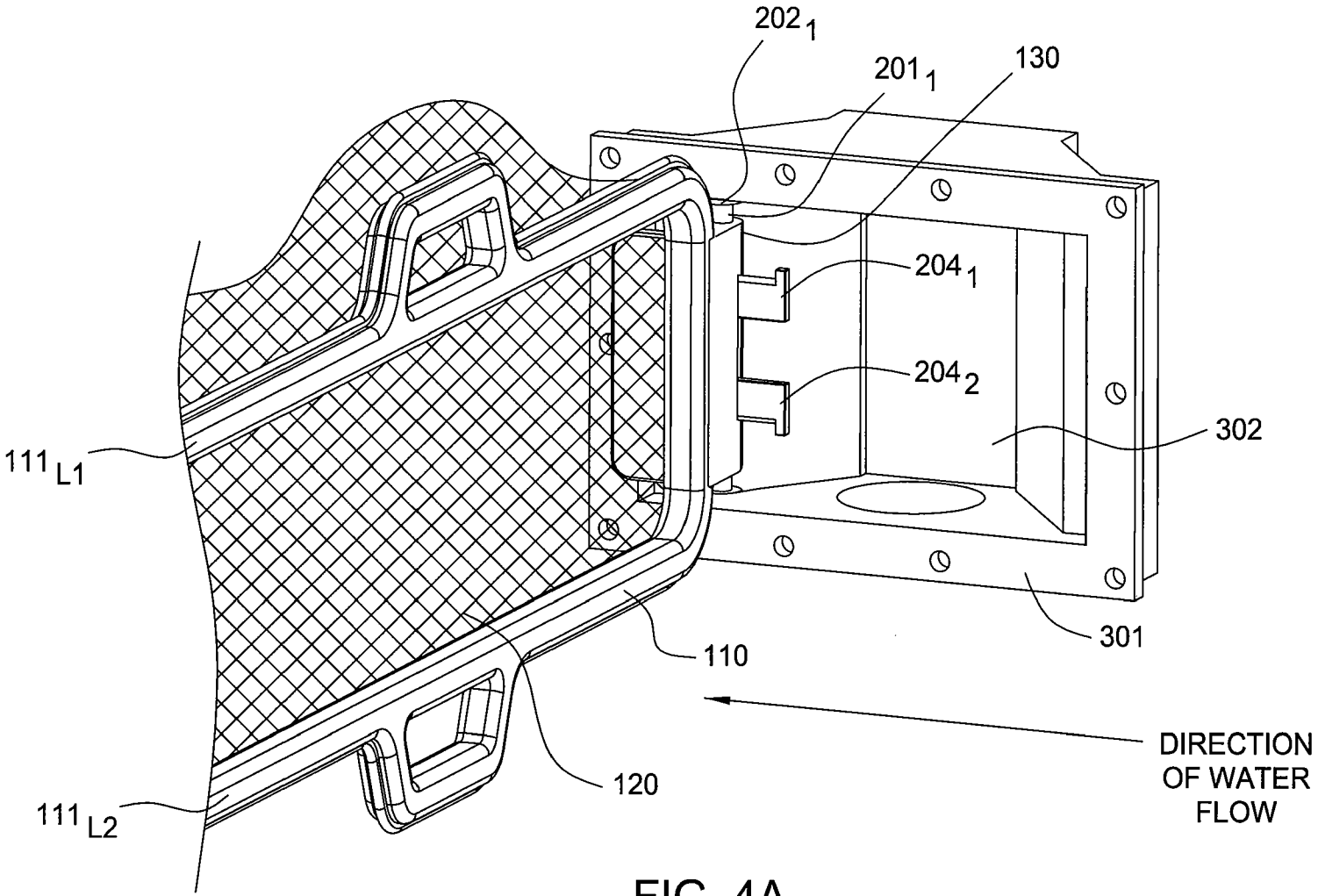
FIGS. 4A and 4B depict a more detailed view of use of the compression mechanism of FIG. 2 to connect the stationary pool skimming apparatus to a skimmer port that is located in the wall of a pool, illustrating connection of the compression mechanism to the skimmer port in inverted and non-inverted positions.
Figure 4B:
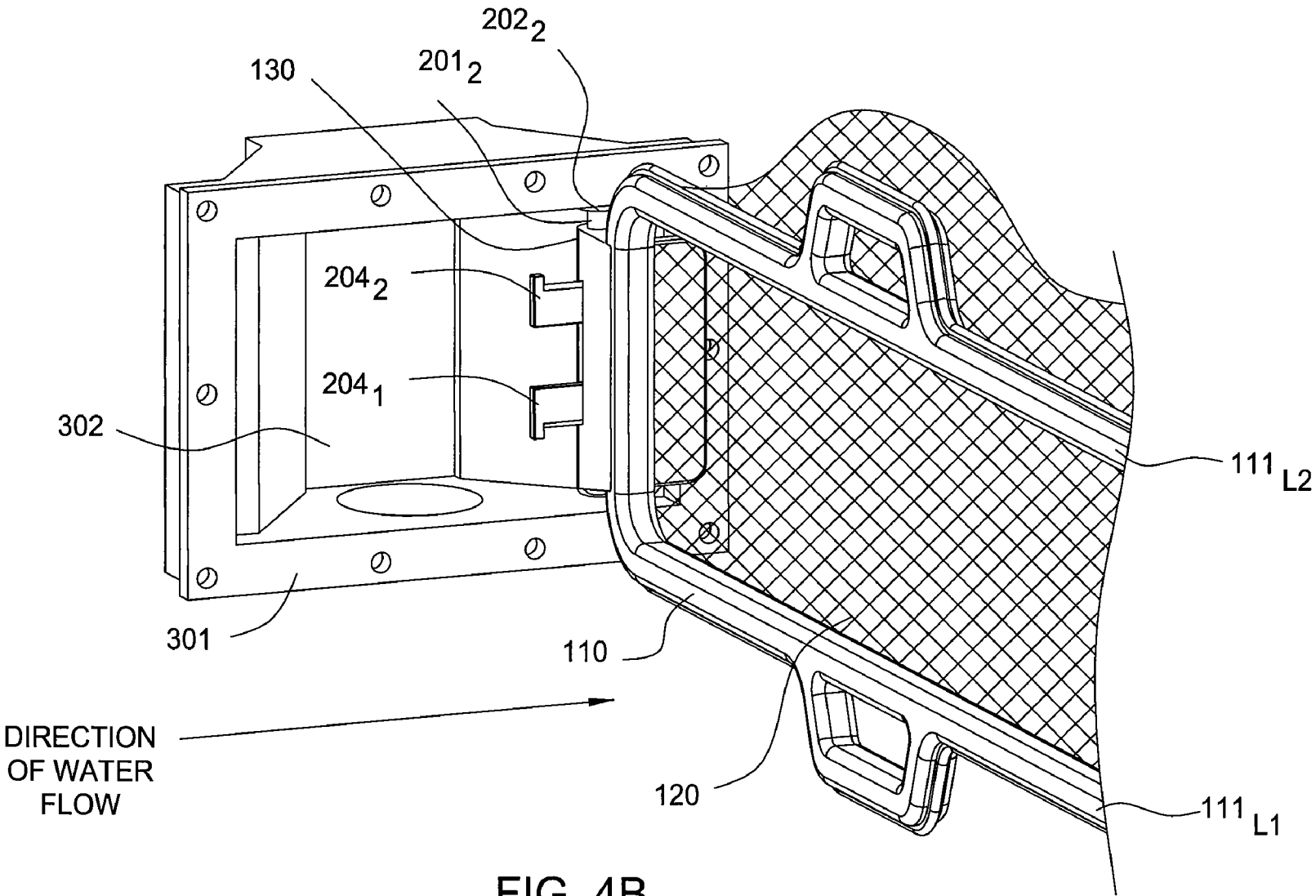

FIGS. 4A and 4B depict a more detailed view of use of the compression mechanism of FIG. 2 to connect the stationary pool skimming apparatus to a skimmer port that is located in the wall of a pool. FIGS. 4A and 4B illustrate connection of the compression mechanism to a skimmer port in inverted and non-inverted positions.

As depicted in FIG. 4A, the direction of the flow of water in the pool is indicated as being from right to left. This direction of water flow is apparent from the position of the net 120 with respect to the frame 110, as well as from the manner in which the stationary pool skimming apparatus 100 is positioned with respect to the opening 302 of skimmer port 301. The stationary pool skimming apparatus 100 is positioned on the side of skimmer port 301 that is opposite the direction from which the water is flowing in the pool (i.e., the stationary pool skimming apparatus 100 is positioned downstream of the direction in which water is flowing in the pool). In this manner, as water flows in the indicated direction within the pool, at least a portion of the free flowing debris in the pool will be directed into the skimmer port 301 through opening 302 and filtered by the skimmer basket (not depicted) in skimmer port 301, while any remaining free flowing debris (which would normally continue to remain in the pool water) will be collected by net 120 of stationary pool skimming apparatus 100 as the water in the pool flows through net 120. Thus, stationary pool skimming apparatus 100 is positioned in a manner enabling stationary pool skimming apparatus 100 to collect free flowing debris from the water in the pool using the flow of water in the pool.

As depicted in FIG. 4A, skimmer gripping ends $\mathbf{202}_1$ and $\mathbf{202}_2$ of the compression mechanism 130 grip the inner wall of the skimmer port 301 in a manner for holding stationary pool skimming apparatus 100 in place to collect free flowing debris from the water in the pool. In FIG. 4A, skimmer gripping end $\mathbf{202}_1$ is gripping an upper inner wall of the skimmer port 301 and skimmer gripping end $\mathbf{202}_2$ (which is obstructed from view by the front face of the skimmer port 301) is gripping a lower inner wall of the skimmer port 301. Also, as depicted in FIG. 4A, stationary pool skimming apparatus 100 is installed such that finger grips $\mathbf{204}_1$ and $\mathbf{204}_2$ are oriented on the side of stationary pool skimming apparatus 100 that is closer to the middle of opening 302 of skimmer port 301, thereby providing easy access to finger grips $\mathbf{204}_1$ and $\mathbf{204}_2$ for use by the user in installing and removing stationary pool skimming apparatus 100.

As described herein, stationary pool skimming apparatus 100 is rotatable such that stationary pool skimming apparatus 100 may be used in any pool, independent of the direction of the flow of water in the pool. Thus, assuming that the flow of water in the pool was in a direction opposite of the direction of water flow depicted in FIG. 4A (i.e., in a direction from left to right, rather than in the direction from right to left that is depicted in FIG. 4A), the stationary pool skimming apparatus 100 would be installed by simply rotating stationary pool skimming apparatus 100 by 180 degrees around its longitudinal axis and installing the stationary pool skimming apparatus 100 on the opposite side of the skimmer port 301. In this configuration, the compression mechanism 130 on proximal end $\mathbf{111}_P$ is again used to connect the stationary pool skimming apparatus 100 to skimmer port 301. This is depicted in FIG. 4B.

As depicted in FIG. 4B, the direction of the flow of water in the pool is indicated as being from left to right (i.e., opposite of the direction of flow of water in FIG. 4A). This direction of water flow is apparent from the position of the net 120 with respect to the frame 110, as well as from the manner in which the stationary pool skimming apparatus 100 is positioned with respect to the opening 302 of skimmer port 301. As in FIG. 4A, in FIG. 4B the stationary pool skimming apparatus 100 is positioned on the side of skimmer port 301 that is opposite the direction from which the water is flowing in the pool (i.e., the stationary pool skimming apparatus 100 is positioned downstream of the direction in which water is flowing in the pool). In this manner, as water flows in the clockwise direction within the pool, at least a portion of the free flowing debris in the pool will be directed into the skimmer port 301 through opening 302 and filtered by the skimmer basket (not depicted) in skimmer port 301, while any remaining free flowing debris (which would normally continue to remain in the pool water) will be collected by net 120 of stationary pool skimming apparatus 100 as the water in the pool flows through net 120. Thus, stationary pool skimming apparatus 100 is positioned in a manner enabling stationary pool skimming apparatus 100 to collect free flowing debris from the water in the pool using the flow of water in the pool.

As depicted in FIG. 4B, skimmer gripping ends $\mathbf{202}_1$ and $\mathbf{202}_2$ of the compression mechanism 130 grip the inner wall of the skimmer port 301 in a manner for holding stationary pool skimming apparatus 100 in place to collect free flowing debris from the water in the pool. In FIG. 4B, skimmer gripping end $\mathbf{202}_2$ is gripping an upper inner wall of the skimmer port 301 and skimmer gripping end $\mathbf{202}_1$ (which is obstructed from view by the front face of the skimmer port 301) is gripping a lower inner wall of the skimmer port 301. Also, as depicted in FIG. 4B, stationary pool skimming apparatus 100 is installed such that finger grips $\mathbf{204}_1$ and $\mathbf{204}_2$ are oriented on the side of stationary pool skimming apparatus 100 that is closer to the middle of opening 302 of skimmer port 301, thereby providing easy access to finger grips $\mathbf{204}_1$ and $\mathbf{204}_2$ for use by the user in installing and removing stationary pool skimming apparatus 100.

In this manner, compression mechanism 130 operates in either of an inverted position and a non-inverted position. For example, connection of stationary pool skimming apparatus 100 to a skimmer port in the manner that is depicted in FIG. 4A may be interpreted as operation of the compression mechanism 130 in an inverted position and connection of stationary pool skimming apparatus 100 to a skimmer port in the manner that is depicted in FIG. 4B may be interpreted as operation of the compression mechanism 130 in a non-inverted position. Similarly, for example, connection of stationary pool skimming apparatus 100 to a skimmer port in the manner that is depicted in FIG. 4B may be interpreted as operation of the compression mechanism 130 in an inverted position and connection of stationary pool skimming apparatus 100 to a skimmer port in the manner that is depicted in FIG. 4A may be interpreted as operation of the compression mechanism 130 in a non-inverted position.

Figure 5:
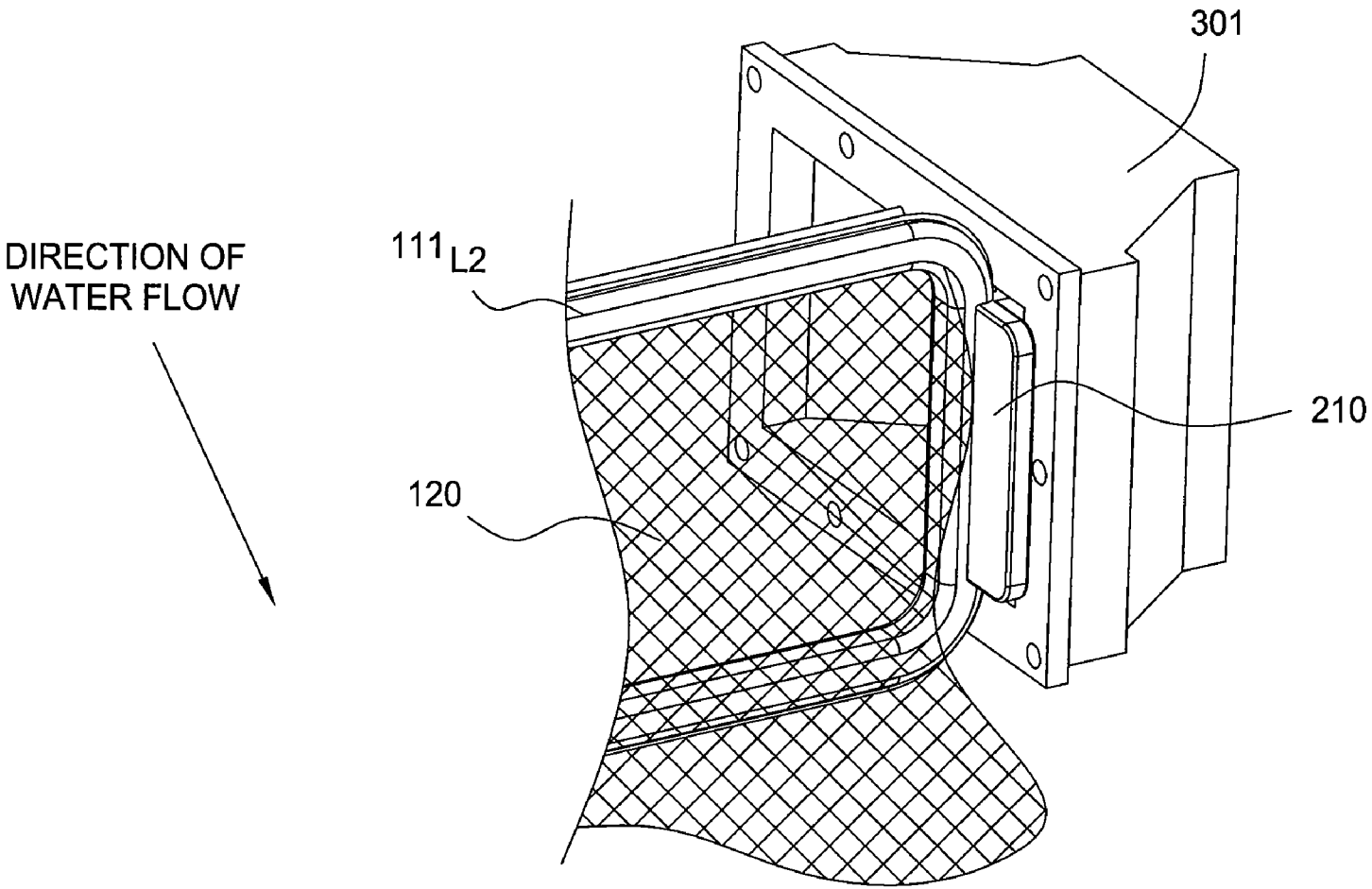
FIG. 5 depicts a more detailed view of use of the compression mechanism of FIG. 2 to connect the stationary pool skimming apparatus to a skimmer port, showing use of a tab of the stationary pool skimming apparatus to reduce movement of the stationary pool skimming apparatus in the direction of the flow of water in the pool.
Figure 6A:
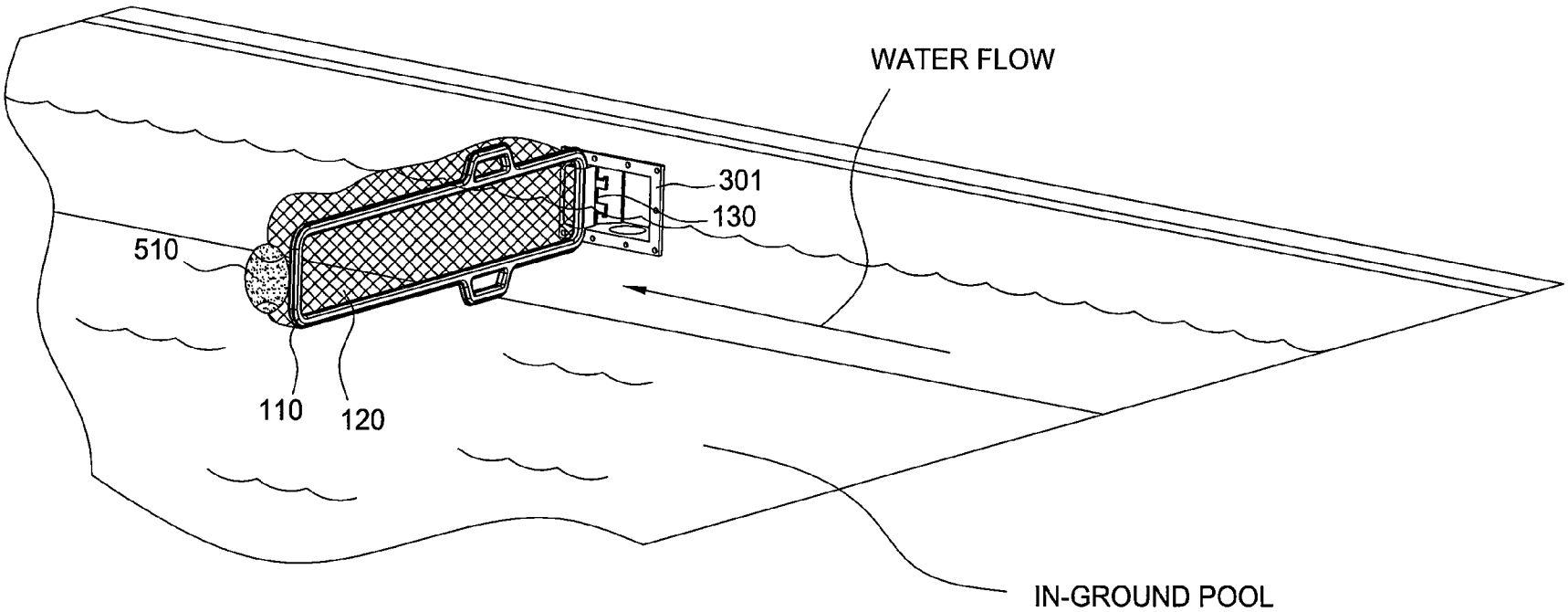
FIG. 6A depicts a view of the stationary pool skimming apparatus of FIG. 1A connected to a skimmer port that is located in the wall of an in-ground pool, illustrating use of a floatation means to buoy the end of the stationary pool skimming apparatus.
Figure 6B:
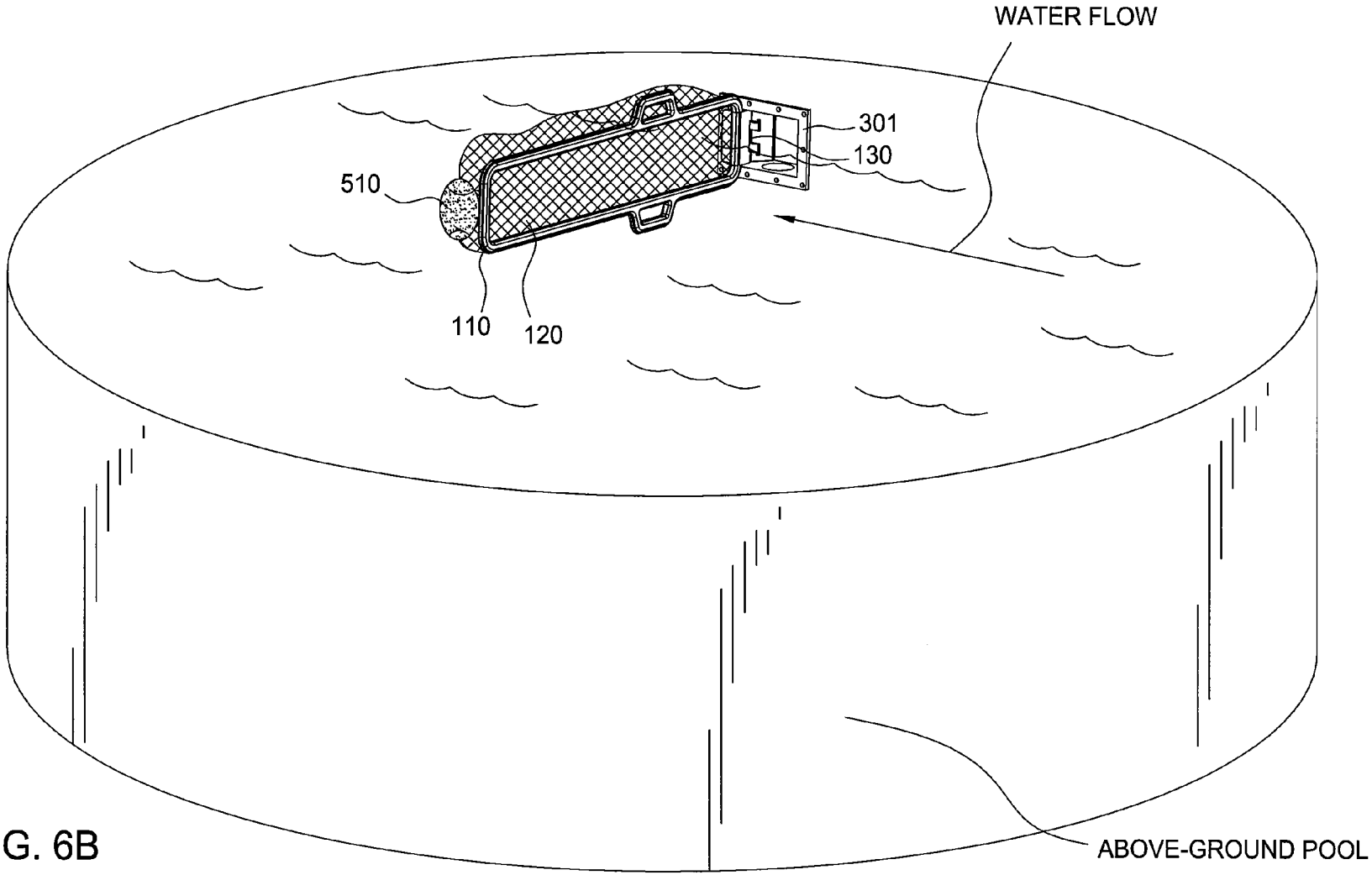
FIG. 6B depicts a view of the stationary pool skimming apparatus of FIG. 1A connected to a skimmer port that is located in the wall of an above-ground pool, illustrating use of a floatation means to buoy the end of the stationary pool skimming apparatus.

The stationary pool skimming apparatus 100 may be adapted in any manner tending to keep the stationary pool skimming apparatus 100 in place for automatic gathering of free flowing debris from the water in the pool. In one embodiment, as depicted in FIG. 2 and FIG. 5, a tab may extend from the stationary pool skimming apparatus 100 to prevent the stationary pool skimming apparatus 100 from moving in the direction in which water is flowing in the pool. In one embodiment, as depicted in FIG. 6A and FIG. 6B, one or more flotation devices may be added to the end of the stationary pool skimming apparatus 100 that extends into the pool (i.e., distal end $\mathbf{111}_D$) in order to prevent the end of stationary pool skimming apparatus 100 that extends into the pool from sinking below the surface of the water in the pool. The stationary pool skimming apparatus 100 may be adapted in various other ways that may tend to keep stationary pool skimming apparatus 100 in place for automatic gathering of free flowing debris from the water in the pool.

FIG. 5 depicts a more detailed view of use of the compression mechanism of FIG. 2 to connect the stationary pool skimming apparatus to a skimmer port, showing use of a tab of the stationary pool skimming apparatus to reduce movement of the stationary pool skimming apparatus in the direction of the flow of water in the pool.

As depicted in FIG. 5, as water flows through net 120, the flowing water exerts a force against the stationary pool skimming apparatus 100 in the direction in which the water is flowing in the pool. The tab 210 that is located on the side of the stationary pool skimming apparatus 100 that is opposite of the direction in which the water is flowing presses against one side of the front face of the skimmer port (i.e., the face of the skimmer port that is parallel to the wall of the pool) such that the side of the front face of the skimmer port provides a support against which the tab rests (i.e., the side of the front face of the skimmer port exerts a force against the tab 210 that counteracts the force exerted against stationary pool skimming apparatus 100 in the direction in which water is flowing), thereby tending to prevent the stationary pool skimming apparatus 100 from moving in the direction in which the water is flowing in the pool.

As depicted in FIG. 5, in the manner in which stationary pool skimming apparatus 100 is installed in the skimmer port, tab 210 is preventing movement of the stationary pool skimming apparatus in the direction of the flow of water in the pool. It should be noted, however, that if the flow of the water in the pool was in a direction opposite of the direction depicted in FIG. 5, the stationary pool skimming apparatus 100 would be installed on the opposite side of the skimmer port such that the free flowing debris in the pool may be collected by both the skimmer port and the stationary pool skimming apparatus 100 (i.e., the stationary pool skimming apparatus 100 would be installed in the skimmer port as depicted in FIG. 4A). In this case, tab 210 would function in a similar manner to prevent stationary pool skimming apparatus 100 from moving in the direction in which the water is flowing.

Thus, at least from FIG. 3, FIGS. 4A and 4B, and FIG. 5, it is apparent that the stationary pool skimming apparatus 100 is adapted for being used in any pool, independent of the direction of the flow of water in the pool. More specifically, stationary pool skimming apparatus 100 is rotatable such that stationary pool skimming apparatus 100 may be used in any pool, independent of the direction of the flow of water in the pool. In the configurations of both FIG. 4A and FIG. 4B, the compression mechanism 130 on proximal end $\mathbf{111}_P$ is used to connect the stationary pool skimming apparatus 100 to skimmer port 301. Thus, in moving the stationary pool skimming apparatus 100 from a pool as depicted in FIG. 4A to a pool as depicted in FIG. 4B (i.e., having water flowing in opposite directions), the stationary pool skimming apparatus 100 is simply rotated by 180 degrees around its longitudinal axis and installed on the opposite side of the skimmer port 301. The stationary pool skimming apparatus 100 is adapted such that, in either installation configuration, the finger grips $\mathbf{204}_1$ and $\mathbf{204}_2$ and one of the handles 140 are readily accessible for use by the user in installing and removing stationary pool skimming apparatus 100, the skimmer gripping ends $\mathbf{202}_1$ and $\mathbf{202}_2$ of the compression mechanism 130 grip the inner wall of the skimmer port 301 in a manner for holding stationary pool skimming apparatus 100 in place to collect free flowing debris from the water in the pool, the tab 210 is aligned with respect to the skimmer port 301 in a manner tending to counteract the force exerted on stationary pool skimming apparatus 100 as water flows against the stationary pool skimming apparatus 100, and the distance by which the ends of the stationary pool skimming apparatus 100 extend above and below the skimmer port opening is such that the net 120 will be able to collect free flowing debris from the water in the pool. In this manner, the compression mechanism 130 is adapted for orienting stationary pool skimming apparatus 100 with respect to an opening in the skimmer port independent of a direction of flow of water in the pool.

FIG. 6A depicts a view of the stationary pool skimming apparatus of FIG. 1A connected to a skimmer port that is located in the wall of an in-ground pool. FIG. 6B depicts a view of the stationary pool skimming apparatus of FIG. 1A connected to a skimmer port that is located in the wall of an above-ground pool. FIG. 6A and FIG. 6B each illustrate use of a floatation means to buoy the end of the stationary pool skimming apparatus.

As depicted in FIG. 6A and FIG. 6B, in one embodiment a flotation means 610 may be added to the end of the stationary pool skimming apparatus 100 (i.e., added the distal end $\mathbf{111}_D$ of the stationary pool skimming apparatus 100, which extends into the pool) in order to prevent the distal end $\mathbf{111}_D$ of the stationary pool skimming apparatus 100 from sinking into the water. In one embodiment, flotation means 610 may be permanently affixed to the distal end $\mathbf{111}_D$ of the stationary pool skimming apparatus 100 that extends into the pool. In one embodiment, flotation means 610 may be adapted for being added to and removed from the distal end $\mathbf{111}_D$ of stationary pool skimming apparatus 100 as needed. The floatation means 610 may include any means of floatation, such as foam, air, and the like.

In one embodiment, the stationary pool skimming apparatus 100 may be made of a light-weight plastic in order to improve the flotation of the stationary pool skimming apparatus 100. In one embodiment, frame 110 of the stationary pool skimming apparatus 100 may be hollow in order to reduce the weight of the stationary pool skimming apparatus 100, and thereby improve the floatation of the stationary pool skimming apparatus 100. The floatation of the stationary pool skimming apparatus 100 may be improved in other ways.

In one embodiment, the stationary pool skimming apparatus is one piece, which makes insertion and removal of the stationary pool skimming apparatus quick and easy. In one embodiment, the stationary pool skimming apparatus is lightweight, which also makes insertion and removal of the stationary pool skimming apparatus quick and easy and, further, assists with the floatation of the stationary pool skimming apparatus.

Although primarily depicted and described herein with respect to embodiments in which compression mechanism 130 includes two pistons and two respective skimmer gripping ends attached thereto, in one embodiment one of the skimmer gripping ends may be attached to a non-movable member such that the compression mechanism 130 includes only a single piston that contracts and expands when actuated by the finger grips 204. In one such embodiment, for example, one of the finger grips associated with the non-movable member will remain stationary such that when the finger grips are squeezed together the movable finger grip will move towards the stationary finger grip in order to enable the stationary pool skimming apparatus to connected to the skimmer port of the pool.

Although primarily depicted and described herein with respect to embodiments in which the skimmer gripping ends of the compression mechanism gripper upper and lower inner walls of the skimmer port, in other embodiments the compression mechanism may be adapted such that the skimmer gripping ends grip first and second inner sidewalls of the skimmer port. In one such embodiment, for example, the compression mechanism may be rotated by approximately 90 degrees with respect to the plane of the frame such that the skimmer gripping ends grip first and second inner sidewalls of the skimmer port while the frame and net remained aligned in a manner for collecting debris from the water in the pool. The compression mechanism may be adapted in various other ways for gripping the skimmer port in various other ways.

Although primarily depicted and described herein with respect to specific shapes, sizes, materials, configurations, features, functions, and the like, the stationary pool skimming apparatus is not limited to such shapes, sizes, materials, configurations, features, and functions. Thus, the stationary pool skimming may be implemented in any manner for enabling the flow of water in a pool to automatically gather free flowing debris from the water in the pool.

Although various embodiments which incorporate the teachings of the present invention have been shown and described in detail herein, those skilled in the art can readily devise many other varied embodiments that still incorporate these teachings.

What is claimed is:

1. A pool skimming apparatus for collecting debris from water in a pool, comprising:

a frame having a net attached thereto, a first end of the frame comprising a compression mechanism adapted for being connected to a skimmer port of a pool such that the net extends into the pool in a manner enabling the net to collect debris from the water in the pool, the compression mechanism operating in either of an inverted position and a non-inverted position, wherein the compression mechanism comprises a gripping means adapted for gripping the skimmer port and an actuating means adapted for actuating the gripping means in a manner enabling connection of the compression mechanism to the skimmer port.

2. The apparatus of claim 1, wherein the net is tapered in a manner tending to direct the debris from a second end of the frame toward the first end of the frame.

3. The apparatus of claim 1, wherein the net is tapered such that a distance with which the net extends behind the frame increases in the direction from a second end of the frame toward the first end of the frame.

4. The apparatus of claim 1, wherein the pool skimming apparatus is adapted such that, when the compression mechanism is connected to the skimmer port, a first portion of the net extends above the surface of the water in the pool and a second portion of the net extends below the surface of the water in the pool, thereby positioning the net with respect to the surface of the water in a manner enabling the net to collect the debris from the water in the pool.

5. The apparatus of claim 1, wherein, when the pool skimming apparatus is connected to the skimmer port, the pool skimming apparatus is connected to the skimmer port substantially near a side of the skimmer port that is opposite a direction from which the water flows in the pool, thereby positioning the net to collect debris that does not enter the skimmer port.

6. The apparatus of claim 1, wherein the gripping means comprises a first gripping end adapted for contacting a first wall of the skimmer port and a second gripping end adapted for contacting a second wall of the skimmer port.

7. The apparatus of claim 6, wherein the first gripping end comprises a first waterproof pad and the second gripping end comprises a second waterproof pad.

8. The apparatus of claim 1, wherein the actuating means comprises a pair of finger grips.

9. The apparatus of claim 8, wherein, when the finger grips are pressed toward each other, the gripping means contracts in a manner enabling the first end of the frame to be positioned within the skimmer port.

10. The apparatus of claim 9, wherein, when the finger grips are released, the gripping means expands in a manner enabling the gripping means to grip the skimmer port of the pool.

11. The apparatus of claim 10, wherein the gripping means comprises a first gripping end and a second gripping end, wherein the first gripping end contacts a first wall of the skimmer port and the second gripping end contacts a second wall of the skimmer port.

12. The apparatus of claim 1, further comprising:

a tab adapted for keeping the frame substantially stationary while water is flowing in the pool.

13. The apparatus of claim 12, wherein the tab is adapted to rest against a face of the skimmer port in a manner tending to counteract a force exerted on the apparatus due to the flow of the water in the pool.

14. The apparatus of claim 1, wherein a second end of the frame comprises at least one floatation means adapted for buoying the second end of the frame.

15. The apparatus of claim 1, further comprising:

at least one handle connected to the frame.

16. The apparatus of claim 1, further comprising:

a first handle connected to a first longitudinal end of the frame; and a second handle connected to a second longitudinal end of the frame.

17. The apparatus of claim 1, wherein the net is attached to an inside edge of the frame in a manner tending to prevent obstruction of the net by the frame.

18. A pool skimming apparatus for collecting debris from water in a pool, comprising:

a frame having a net attached thereto, a first end of the frame comprising a compression mechanism adapted for being connected to a skimmer port of a pool such that the net extends into the pool in a manner enabling the net to collect debris from the water in the pool, wherein the compression mechanism is adapted for orienting the pool skimming apparatus with respect to an opening in the skimmer port independent of a direction of flow of water in the pool, wherein the compression mechanism comprises a gripping means adapted for gripping the skimmer port and an actuating means adapted for actuating the gripping means in a manner enabling connection of the compression mechanism to the skimmer port.

19. A pool skimming apparatus for collecting debris from water in a pool, comprising:

a frame having a net attached thereto, the frame comprising a compression mechanism adapted for being connected to a skimmer port of a pool such that the net extends into the pool in a manner enabling the net to collect debris from the water in the pool, wherein the compression mechanism comprises a gripping means adapted for gripping the skimmer port and an actuating means adapted for actuating the gripping means in a manner enabling connection of the compression mechanism to the skimmer port.

* * * * *